US006378260B1

(12) United States Patent
Williamson et al.

(10) Patent No.: US 6,378,260 B1
(45) Date of Patent: Apr. 30, 2002

(54) CONCRETE FORMING SYSTEM WITH BRACE TIES

(75) Inventors: Jay D. Williamson, Papillion; Thomas E. Whitmore; David Henney, both of Omaha, all of NE (US); Kelly G. Chandler; Robert D. Grove, both of Elbow Lake, MN (US)

(73) Assignee: Phoenix Systems & Components, Inc., Papillion, NE (US)

( * ) Notice: Subject to any disclaimer, the term of this patent is extended or adjusted under 35 U.S.C. 154(b) by 0 days.

(21) Appl. No.: 09/614,966

(22) Filed: Jul. 12, 2000

(51) Int. Cl.[7] ..... E04B 2/00

(52) U.S. Cl. ..... 52/426; 52/562; 52/565; 52/699; 52/693; 52/309.12

(58) Field of Search ..... 52/426, 562, 309.12, 52/309.11, 564, 565, 712, 693, 427, 428

(56) References Cited

U.S. PATENT DOCUMENTS

| | | | | |
|---|---|---|---|---|
| 3,286,428 | A | | 11/1966 | Kay |
| 4,604,843 | A | | 8/1986 | Ott |
| 4,706,429 | A | | 11/1987 | Young |
| 4,730,422 | A | | 3/1988 | Young |
| 4,742,659 | A | | 5/1988 | Meilleur |
| 4,852,317 | A | | 8/1989 | Schiavello et al. |
| 4,879,855 | A | | 11/1989 | Berrenberg |
| 4,889,310 | A | | 12/1989 | Boeshart |
| 4,901,494 | A | | 2/1990 | Miller et al. |
| 4,936,540 | A | | 6/1990 | Boeshart |
| 5,065,561 | A | | 11/1991 | Mason |
| 5,390,459 | A | | 2/1995 | Mensen |
| 5,454,199 | A | | 10/1995 | Blom et al. |
| 5,459,971 | A | | 10/1995 | Sparkman |
| 5,491,949 | A | | 2/1996 | De Moor |
| 5,566,518 | A | | 10/1996 | Martin et al. |
| 5,568,710 | A | | 10/1996 | Smith et al. |
| 5,570,552 | A | | 11/1996 | Nehring |
| 5,611,183 | A | | 3/1997 | Kim |
| 5,617,693 | A | | 4/1997 | Hefner |
| 5,657,600 | A | | 8/1997 | Mensen |
| 5,701,710 | A | | 12/1997 | Tremelling |
| 5,704,180 | A | | 1/1998 | Boeck |
| 5,709,060 | A | | 1/1998 | Vaughan et al. |
| 5,735,093 | A | * | 4/1998 | Grutsch ..... 52/309.11 |
| 5,803,669 | A | | 9/1998 | Bullard |
| 5,809,728 | A | | 9/1998 | Tremelling |
| 5,845,449 | A | * | 12/1998 | Vaughan et al. ..... 52/565 |
| 5,896,714 | A | * | 4/1999 | Cymbala et al. ..... 52/426 |

* cited by examiner

*Primary Examiner*—Carl D. Friedman
*Assistant Examiner*—Jennifer I. Thissell
(74) *Attorney, Agent, or Firm*—Chase Law Firm, L.C.

(57) ABSTRACT

A form tie for joining a pair of form sidewalls includes first and second vertical struts presenting planar nailing surfaces for embedding in the first and second sidewalls. A web obliquely extends between the struts and across the cavity between the laterally spaced-apart sidewalls. The web includes a top strut which slopes between the vertical struts and across the cavity. The form ties are alternately placed in alternate 180° orientations along the sidewalls such that the web extends in alternate directions across the cavity which enhances the form rigidity. Concurrently, the top web strut slopes in opposed direction to form a V-type seat for placement of a horizontal rebar within the cavity.

16 Claims, 5 Drawing Sheets

CONCRETE FORMING SYSTEM WITH BRACE TIES

BACKGROUND OF THE INVENTION

This invention relates to a concrete forming system and, more particularly, to a novel form tie for maintaining the sidewalls of a concrete form in desired spaced-apart relationships.

Concrete forms made of a polymeric foam material are known. Such forms basically comprise a pair of laterally spaced-apart sidewalls presenting a cavity therebetween. A plurality of these forms are connected to present longitudinally and vertically aligned cavities for pouring concrete therein.

One problem with the use of concrete forms is that the sidewall pairs must be immobilized so as to resist pressures on the walls during transport and, more importantly, during concrete pouring and curing. If not, the form sidewalls may shift in lateral and/or vertical and/or longitudinal directions. Such displacements make it difficult to easily connect the forms. Also, the forms may separate along the joints respectively presented along the zones of connection between longitudinally and vertically adjacent forms. If not sufficiently braced the concrete can cause these joints to separate. The industry refers to such separations as "blow outs".

Accordingly, various form tie devices, e.g., braces and permanent tension members, have been proposed so as to maintain the sidewalls in place to preclude such shifting and/or "blow outs". However, such devices have been relatively complex in construction requiring the sidewalls to have special configurations so as to utilize the form ties.

In response thereto we have invented novel form ties for use in concrete forms which effectively interface with the form sidewalls so as to maintain the walls in a desired spatial relationship during transport as well as concrete pouring and curing. Our forms also automatically present a longitudinally extended seat for easily positioning horizontal rebar in the cavity formed between the sidewalls.

It is therefore a general object of this invention to provide a novel form tie for use in a concrete forming system.

A further object of this invention is to provide a form tie, as aforesaid, which is incorporated in the concrete form during the blow molding thereof.

Another general object of this invention is to provide a form tie, as aforesaid, which resists loads that impart tension, compression, bending, twisting and lateral stresses acting thereon.

Still a further object of this invention is to provide a form tie, as aforesaid, which diminishes the lateral, vertical and longitudinal displacement of adjacent sidewalls of a concrete form during transport and use.

Another particular object of this invention is to provide a form tie, as aforesaid, which enhances on-site assembly of the concrete forms, inclusive of the placement of horizontal rebar therein.

A further object of this invention is to provide a form tie, as aforesaid, which effectively resists the forces arising from concrete flow but without interference with the concrete flow in the cavity between the form sidewalls and between adjacent forms.

A particular object of this invention is to provide a form tie, as aforesaid, having a web which extends at an angle across the cavity so as to resist the forces acting thereon.

Another object of this invention is to provide a form tie, as aforesaid, wherein the web includes a sloped surface used to present a seat for placement of a longitudinally extending rebar therein.

Other objects and advantages of this invention will become apparent from the following description taken in connection with the accompanying drawings, wherein is set forth by way of illustration and example, a now preferred embodiment of this invention.

DESCRIPTION OF THE PREFERRED EMBODIMENT

Figure 9:
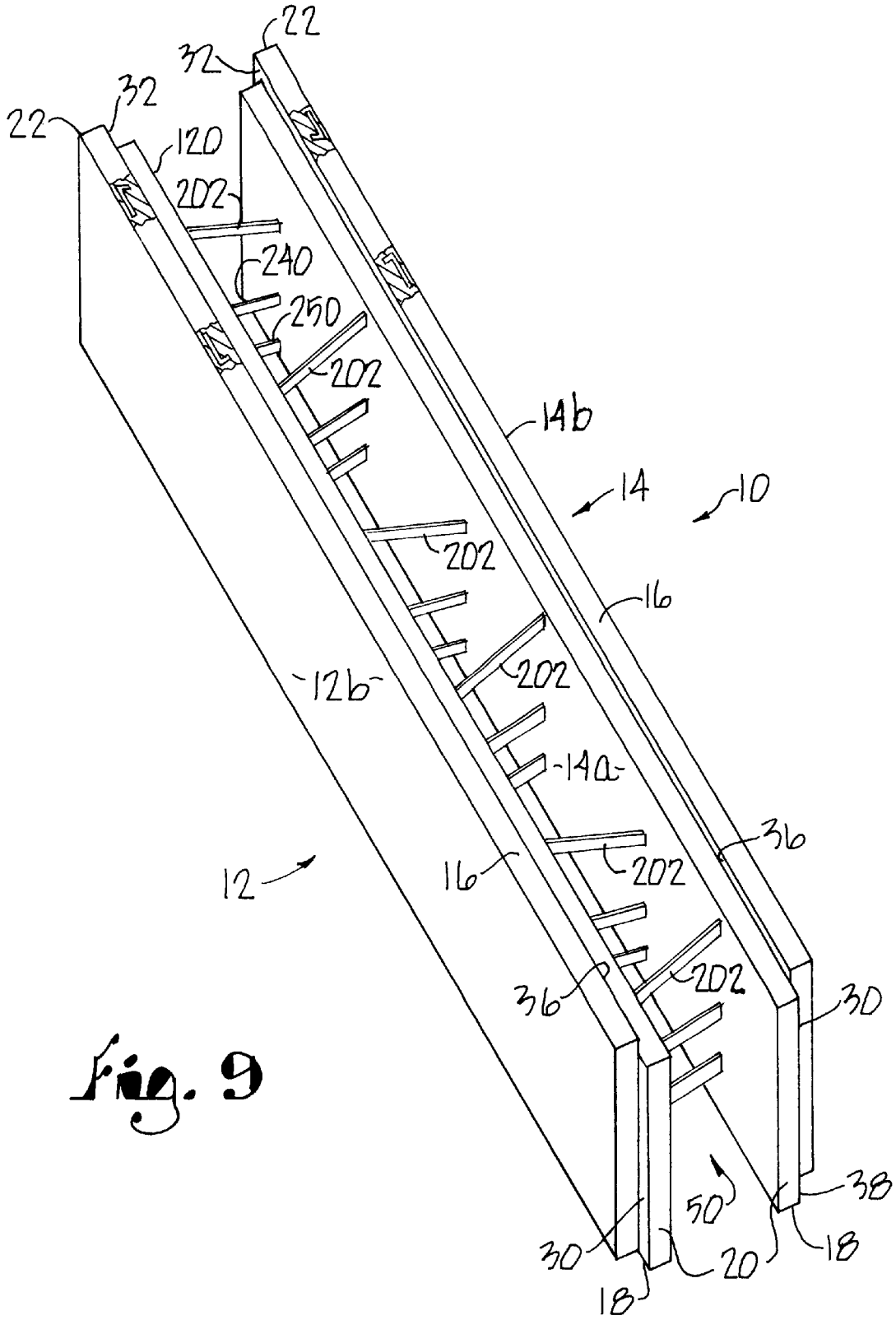
FIG. 9 is a view of the ties joining two sidewalls of a concrete form with a portion of the top edges at one end of the sidewall removed to show the struts embedded therein.

Turning more particularly to the drawings, FIG. 9 shows one type of concrete form 10 as generally comprising a pair of sidewalls 12, 14. Each sidewall has upper 16 and lower 18 longitudinal edges as well as a pair of opposed vertical edges 20, 22. The sidewalls 12, 14 present interior facing surfaces 12*a*, 14*a* and exterior facing surfaces 12*b*, 14*b*. The parallel walls 12, 14 cooperate to form a cavity 50 which spans the length of the form 10.

At opposed ends 20, 22 of the sidewalls 12, 14 are presented vertical lap surfaces 30, 32. At the top edge of the sidewalls longitudinal lap surfaces 36 are presented as well as lap surfaces 38 along the bottom edge of the sidewall 26. These lap surfaces allow longitudinally and/or vertically adjacent forms 10 to be connected in a lap joint relationship therebetween.

Although not shown it is understood that the first course of longitudinally joined forms are positioned atop a footing and held in place by various materials such as plastic roof cement. It is understood that other types of connection of the first row of longitudinal forms to the footing may be utilized such as placing the forms in a wet footing and allowing the footing to subsequently dry. Upon reaching a desired length and height of the form courses, concrete is poured into the cavity 50 formed between the form sidewalls 12, 14. (It is understood that the forms are staggered among rows so as to preclude formation of a continuous vertical joint among the form rows.) The poured concrete fills the cavities 50. Thus a concrete wall, resulting from concrete poured within the aligned cavities 50, is presented. The forms 10 are left in place for insulating the resulting concrete wall.

It is known that the courses of the forms may be selectably configured so as to present walls of various configurations. Also, door frames, window frames, bucks, bulkheads, and the like may interrupt the courses of forms so as to provide openings for insertion of doors, windows and the like therein while precluding spillage of poured concrete from the forms.

During the pouring of the concrete a hydraulic concrete load acts on the sidewalls 12, 14 of each form 10 as well as on any structure, e.g., the form tie webs 200, spanning the cavity 50 between such sidewalls 12, 14. The hydraulic load urges the sidewalls 12, 14 from their proper vertical, lateral and longitudinal spatial relationships. Also during form transport to the job site, the sidewalls 12, 14 may be displaced due to the weight of other forms stacked thereon. In some cases the distance between the sidewalls 12, 14 may vary. Accordingly, it is desirable to provide form ties which will keep the form sidewalls in their proper relationship during manufacture, transport, storage and use.

Figure 10:
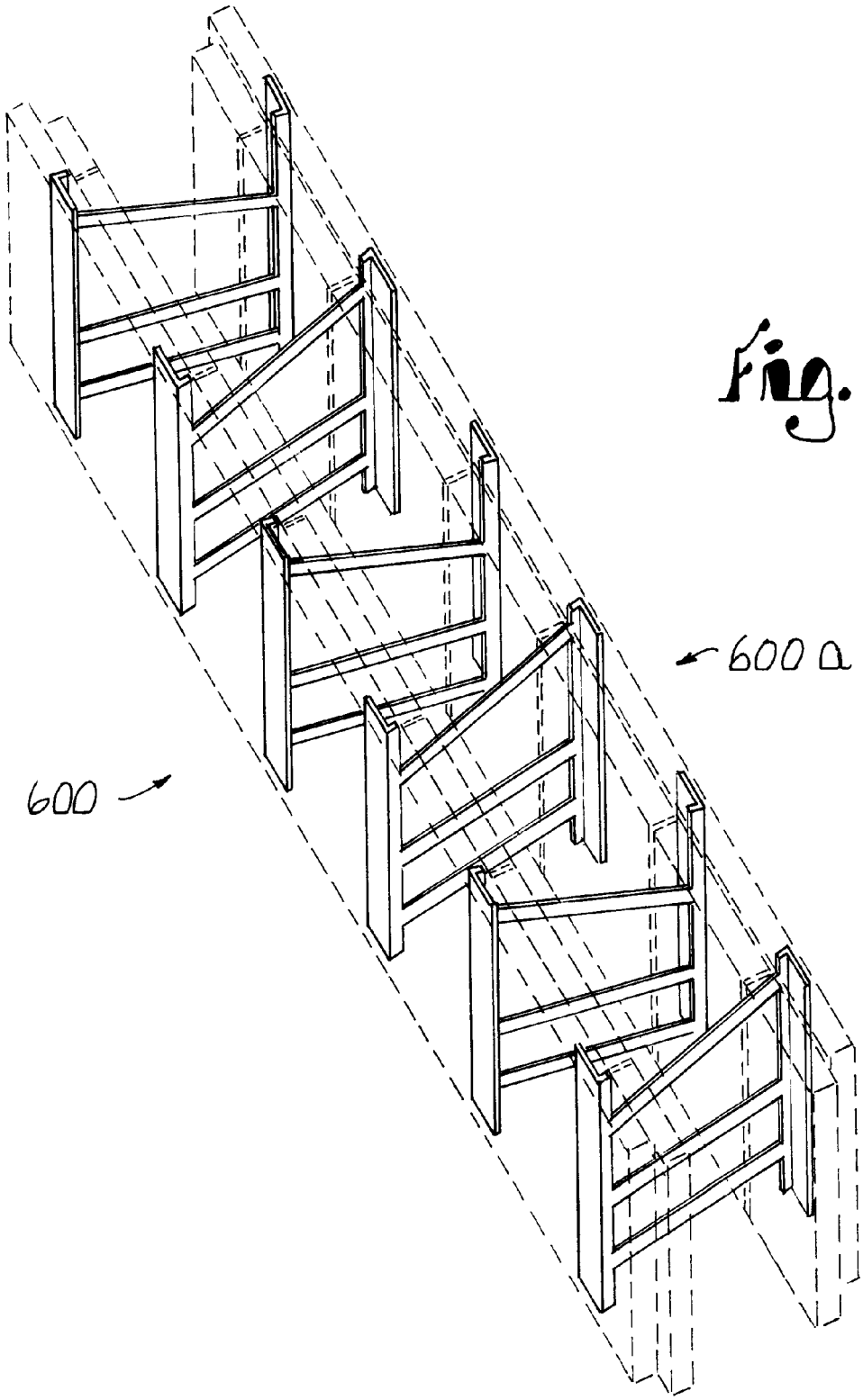
FIG. 10 shows the placement of the ties within the molds prior to the injection of the foam material therein.

As shown in FIG. 10, two bipartite molds 600, 600*a* are used for forming the sidewalls 12, 14 of the polymeric concrete form 10. The form ties are pre-inserted within slots in the molds in alternating 180° relationships. Polystyrene beads are blown into the respective sidewall molds at a first temperature with the beads expanding upon cooling so as to fill the mold. Upon the beads being reheated at an elevated temperature, a second expansion occurs so that the foam fills the mold. Upon removal of the mold the sidewalls with forms ties 200 in place are presented (FIG. 9).

Figure 7:
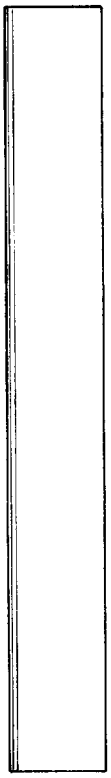
FIG. 7 is a plan view of one of the vertical struts of the FIGS. 1–3 form.
Figure 8:
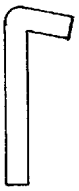
FIG. 8 is an end view of the FIG. 7 strut on an enlarged scale.
Figure 12:
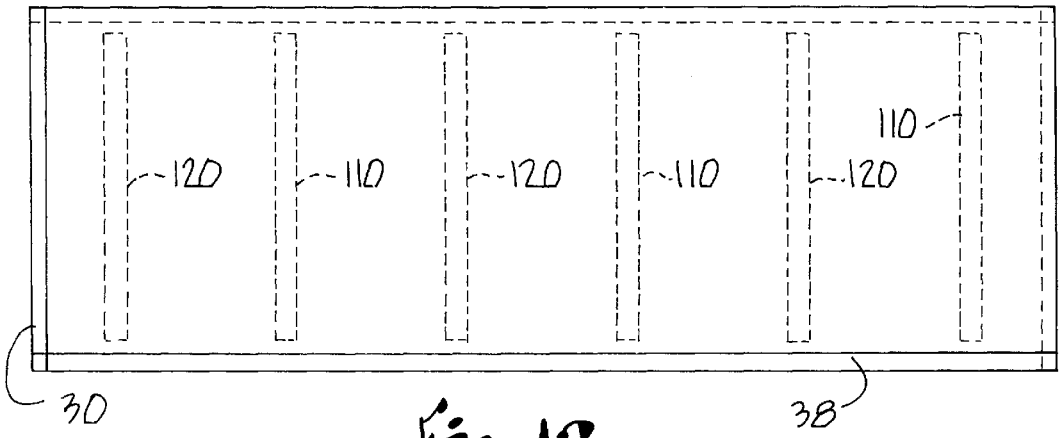
FIG. 12 is a diagrammatic elevation view of FIG. 11.

Our improved form tie 100 is integrated into the form during the molding thereof. Each tie generally comprises first and second struts 110, 120, presenting a planar face 112, 122 (FIG. 7) which are alternately embedded in the respective sidewalls 12, 14 during the molding process. As shown in FIG. 12, the faces of the struts 110, 120 present a planar nailing surface which vertically span the exterior facing surface 12*b*, 14*b* of each form sidewall 12, 14 but at a slight displacement from the exterior.

Figure 1:
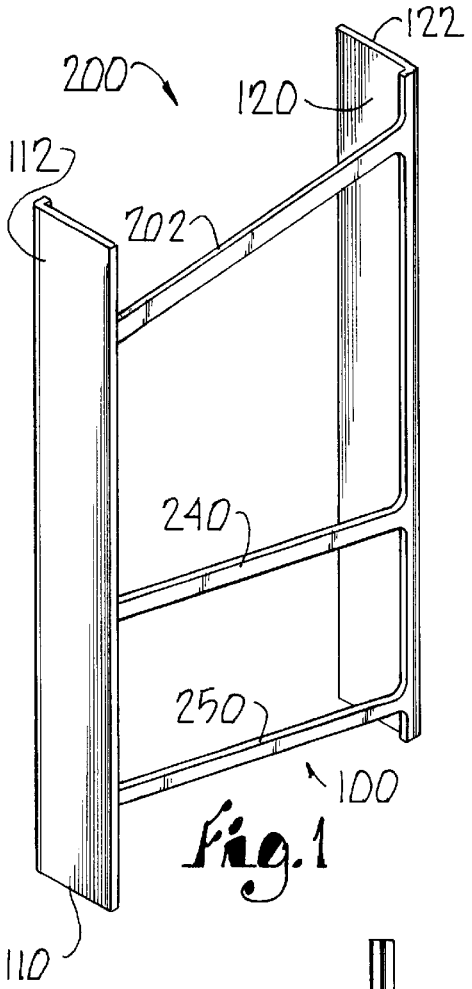
FIG. 1 is a perspective view of a form tie oriented in a first direction.
Figure 2:
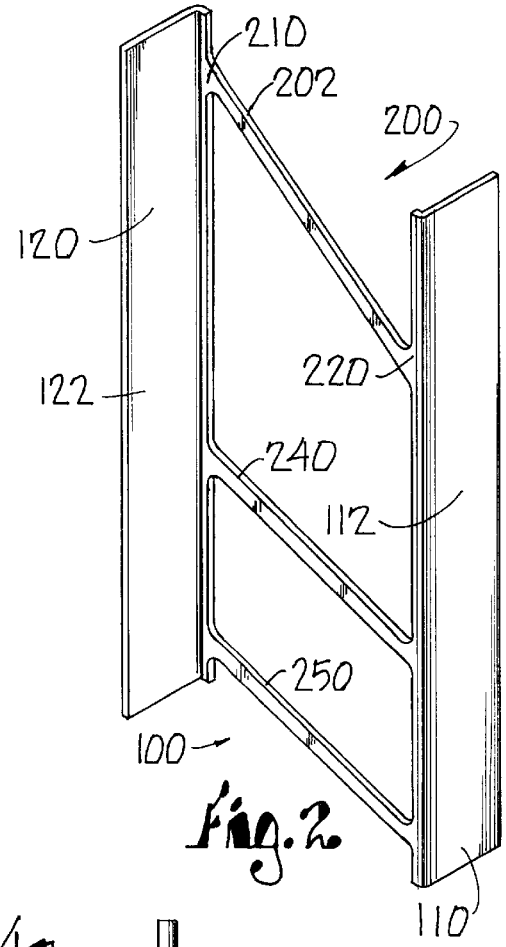
FIG. 2 is a perspective view of the FIG. 1 form tie oriented in a second direction.
Figure 3:
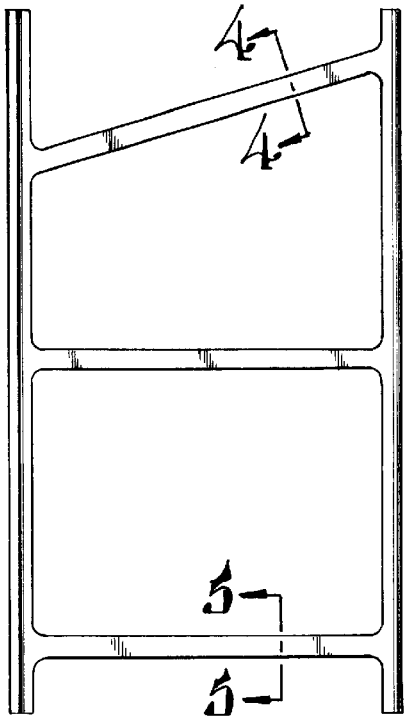
FIG. 3 is a front elevation view of the FIG. 1 form tie.
Figure 4:
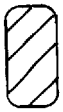
FIG. 4 is a view of a strut of the form tie taken along lines 4—4 in FIG. 3.
Figure 6:
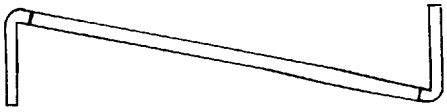
FIG. 6 is a top Z-shaped view of the FIG. 3 form.
Figure 5:
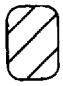
FIG. 5 is a view of a strut of the form tie taken along lines 5—5 in FIG. 3.

Angularly extending between these first and second struts 110, 120 is a web 200. The web as shown in FIGS. 1, 2 angularly extend from one edge of the face 112 of strut 110 to an opposed vertical edge of the face 122 of the opposed parallel strut 120. Thus, the web 200 ends form an acute angle with the planar surface of each strut 110, 120.

The Z-shaped web (as viewed from the top) includes a top strut 202 having first and second ends 210, 220. As shown the end 210 at strut 110 is displaced at a lower position along strut 110 relative to the higher end 220 adjacent strut 120. Thus, the obliquely extending strut 202 also slopes between struts 110, 120 as shown in FIGS. 1, 2.

Below strut 202 are parallel, horizontal reinforcing struts 240, 250 which likewise diagonally extend between struts 110, 120 in the same vertical plane as strut 202.

Figure 11:
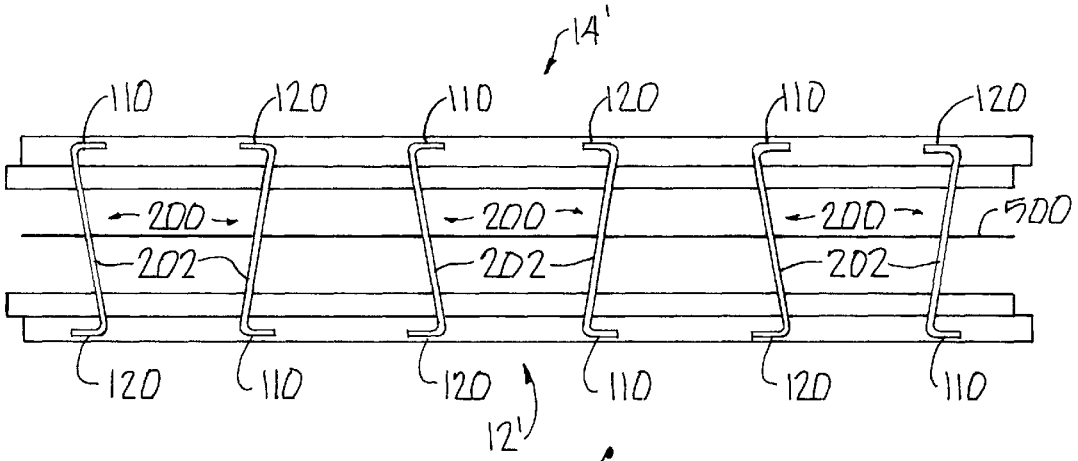
FIG. 11 is a top diagrammatic view showing the alternating placement of the form ties in the form sidewalls.
Figure 13:
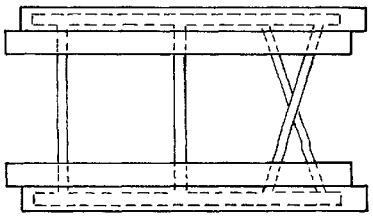
FIG. 13 is a diagrammatic view of the top inclined struts of the webs of the form ties as viewed from one end of the form.

As shown in FIGS. 10, 11 the plurality of improved ties 100 are positioned in alternate 1800 orientations between the sidewalls 12, 14 such that the first and second struts 110, 120 of each successive tie 100 are alternately positioned in the first 12 and second 14 sidewalls. As each adjacent tie is rotated 180° the struts 110, 120 of one tie 100 are respectively located in sidewalls 12, 14 with the struts 110, 120 of an adjacent tie 100 located in sidewalls 14, 12. As such the webs 200, as viewed relative to wall 12, extend in opposed angular directions across the cavity 50 and relative to wall 12 or wall 14 (FIG. 11). Also, as diagrammatically shown in FIG. 13, the top inclined strut of each form tie will alternately slope up or down relative to the sidewalls due to the alternating 180° orientation among the adjacent ties 100. The plurality of these inclined struts 202 cooperate to form a longitudinally extended V-type rest/seat upon which a horizontal rebar 500 (FIG. 11) is placed such that rebar 500 is centrally placed within the cavity 50. Vertical rebar can then be tied to the horizontal rebar 500. This strut 202 relationship thus presents a guide for the efficient central placement of horizontal rebar within the cavity 50.

We have also found that by extending the webs 200 in alternating, oblique extensions across the cavity 50 that form rigidity is enhanced, particularly in the face of the concrete flow as the webs 200 do not present a face flush with the initial concrete flow. For example, if the concrete is poured in at one end of the form, e.g., the left end (as viewed) of FIG. 11, the concrete flow will initially contact the forwardmost portions of the web 200 and then sequentially contact the rearward portions. This web response to the concrete flow will be reversed as the adjacent web 200 angularly extends in an opposed direction. This action continues as the flow reaches successive downstream webs due to the alternating angles of web extension between the sidewalls. The webs 200, as so angularly extended, thus enhance form stability during concrete flow as well as during form transport and/or storage.

We have also found that the Z-shaped configuration allows the ties 100 to easily nest and/or stack for efficient transport.

The dimensions shown in the accompanying drawings are for purposes of illustration of our now preferred embodiment and not as limitations on our invention.

It is to be understood that while certain forms of this invention have been illustrated and described, it is not limited thereto, except in so far as such limitations are included in the following claims.

Having thus described the invention, what is claimed as new and desired to be secured by Letters Patent is:

1. In a concrete form comprising first and second laterally spaced-apart sidewalls for presenting a cavity therebetween, the sidewalls joined by a plurality of improved form ties, each improved form tie comprising:

a first strut embedded in one of the sidewalls;

a second strut laterally displaced from the first strut and embedded in the other of said sidewalls in a parallel relationship with said fist strut;

an uppermost third strut extending between said first and second struts and for bridging the cavity between the first and second sidewalls, said third strut inclined between said first strut and said second strut;

at least one reinforcement strut below said third strut extending between said first and second struts, a plurality of said improved ties joining said sidewalls in a longitudinally spaced-apart relationship, said first and second struts of each form tie alternately positioned in said first or second sidewalls, whereby said uppermost third struts of successively adjacent ties alternately slope in up or down directions between said first and second sidewalls to present a seat adapted for placement of a longitudinally extending rebar atop the cavity between the first and second sidewalls.

2. The form tie as claimed in claim 1 wherein said first and second struts vertically extend in said respective sidewalls.

3. The form tie as claimed in claim 2 wherein said first and second struts are adjacent a respective exterior surface of each said sidewall to present a nailing surface.

4. The form tie as claimed in claim 1 wherein said first and second struts present a planar surface.

5. The form tie as claimed in claim 1 wherein said inclined third strut obliquely angularly extends between said first and second struts.

6. The form tie as claimed in claim 5 wherein said at least one reinforcement strut angularly extends between said first and second struts.

7. The form tie as claimed in claim 1 wherein said at least one reinforcement strut comprises a pair of reinforcement struts extending below said third strut and between said first and second struts embedded in said sidewalls.

8. The form tie as claimed in claim 1 wherein said third strut extends in an angular direction across the cavity and between said first and second struts.

9. In a concrete form comprising first and second laterally spaced-apart sidewalls for presenting a cavity therebetween, the sidewalls joined by a plurality of improved form ties, each improved form tie comprises:

a first strut embedded in one of the sidewalls;

a second strut laterally displaced from the first shut and embedded in the other of said sidewalls;

a web extending between said first and second struts for bridging the cavity between the first and second sidewalls, said web presenting a single uppermost inclined surface between said first and second struts, a plurality of said improved ties connecting the sidewalls in a manner whereby said uppermost inclined surface of each of said webs alternately incline in up or down directions relative to one of said sidewalls to present a seat adapted for placement of a longitudinally extending rebar therein.

10. The form tie as claimed in claim 9 wherein said web extends in an angular direction across the cavity and between said first and second struts.

11. The form tie as claimed in claim 10 wherein said web includes at least one reinforcement strut extending between said first and second struts and below said inclined surface.

12. The form tie as claimed in claim 9 wherein said fast and second struts present planar surfaces, said uppermost inclined surface of each web angularly extending between said respective planar surfaces.

13. The form tie as claimed in claim 9 wherein said inclined surface comprises a single inclined struts having first and second ends with said first end joined to said first struts at a position adjacent a top end of said first strut and said second end adjacent a top end of said second strut.

14. The form tie as claimed in claim 10 wherein said inclined surface of a web of one form tie is oriented relative to said inclined surface of a web of an adjacent form tie to extend said inclined surfaces of webs of adjacent form ties between the sidewalls in opposed angular directions relative to said first and second strut.

15. The form tie as claimed in claim 11 wherein said at least one reinforcement strut comprises a pair of reinforcement struts extending between said first and second struts.

16. The form tie as claimed in claim 15 wherein said reinforcement struts angularly extend across said cavity and between said first and second struts.

* * * * *

UNITED STATES PATENT AND TRADEMARK OFFICE

CERTIFICATE OF CORRECTION

PATENT NO. : 6,378,260 B1 
DATED : April 30, 2002
INVENTOR(S) : Jay D. Williamsom, Thomas E. Whitmore, David Henney, Kelly G. Chandler and Robert D. Grove It is certified that error appears in the above-identified patent and that said Letters Patent is Column 4,
Line 66, delete "obliquely".

Column 5,
Line 16, delete "shut" and substitute -- strut --.

Column 6,
Line 7, delete "fast" and substitute -- first --.
Line 11, delete "struts" and substitute -- strut --.
Line 13, delete "struts" and substitute -- strut --.
Line 20, delete "strut" and substitute -- struts --.

Signed and Sealed this

Second Day of July, 2002

*Attest:*

*Attesting Officer*

JAMES E. ROGAN
*Director of the United States Patent and Trademark Office*